US006651278B2

(12) United States Patent
Ghanem

(10) Patent No.: US 6,651,278 B2
(45) Date of Patent: Nov. 25, 2003

(54) QUICK CHANGE BEDSHEET SET

(76) Inventor: Darlene Diak Ghanem, 299 NE. Spanish Trail, Boca Raton, FL (US) 33432

( * ) Notice: Subject to any disclaimer, the term of this patent is extended or adjusted under 35 U.S.C. 154(b) by 0 days.

(21) Appl. No.: 09/976,797

(22) Filed: Oct. 12, 2001

(65) Prior Publication Data

US 2003/0070232 A1 Apr. 17, 2003

(51) Int. Cl.[7] ..... A47G 9/04
(52) U.S. Cl. ..... 5/496; 5/484; 5/923
(58) Field of Search ..... 5/482, 484, 485, 5/486, 488, 496, 497, 498, 499, 500, 502, 922, 923

(56) References Cited

U.S. PATENT DOCUMENTS

| | | | | | |
|---|---|---|---|---|---|
| 2,400,731 | A | * | 5/1946 | Armstrong | 5/500 |
| 2,907,055 | A | * | 10/1959 | Berman | 5/496 |
| 3,027,573 | A | * | 4/1962 | Bell, Jr. | 5/738 |
| 3,576,039 | A | * | 4/1971 | Roberts | 5/484 X |
| 3,670,345 | A | * | 6/1972 | Doll et al. | 5/484 |
| 3,871,037 | A | * | 3/1975 | Willington | 5/484 X |
| 3,965,504 | A | * | 6/1976 | Ainsworth | 5/496 X |
| 3,974,308 | A | * | 8/1976 | Winters | 5/484 X |
| 4,173,046 | A | * | 11/1979 | Gallagher | 5/484 |
| 4,301,561 | A | * | 11/1981 | McLeod | 5/496 |
| 4,391,010 | A | * | 7/1983 | Kronman | 5/484 |
| 4,704,753 | A | * | 11/1987 | Lunt | 5/484 |
| 4,813,944 | A | * | 3/1989 | Haney et al. | 5/484 X |
| 4,922,565 | A | | 5/1990 | Blake | 5/484 |
| 5,042,099 | A | * | 8/1991 | Brenner et al. | 5/502 |
| 5,065,485 | A | * | 11/1991 | Zocco | 29/91.1 |
| 5,086,530 | A | | 2/1992 | Blake | 5/484 |
| 5,208,926 | A | * | 5/1993 | Stackhouse | 5/482 |
| 5,249,320 | A | * | 10/1993 | Moretz et al. | 5/484 |
| 5,252,374 | A | * | 10/1993 | Larsonneur | 5/484 X |
| 5,321,862 | A | * | 6/1994 | Campbell | 5/482 |
| 5,323,501 | A | * | 6/1994 | Kuhangel | 5/499 |
| 5,350,625 | A | * | 9/1994 | Peterson et al. | 5/484 X |
| 5,367,729 | A | * | 11/1994 | Lazar et al. | 5/496 X |
| 5,572,754 | A | * | 11/1996 | Lazar et al. | 5/496 X |
| 5,701,617 | A | | 12/1997 | Colby | 5/484 |
| 5,787,523 | A | * | 8/1998 | Lindberg | 5/484 X |
| 5,787,527 | A | * | 8/1998 | Anderson | 5/484 |
| 6,067,677 | A | | 5/2000 | Reen et al. | 5/499 |
| 6,098,219 | A | * | 8/2000 | Milber | 5/498 X |
| 6,243,895 | B1 | * | 6/2001 | Amin | 5/498 |
| 6,253,398 | B1 | * | 7/2001 | Yim | 5/499 |
| 6,263,532 | B1 | * | 7/2001 | Miller | 5/690 |
| 6,381,779 | B1 | * | 5/2002 | Thompson | 5/484 X |
| 2002/0053108 | A1 | * | 5/2002 | Goyarts | 5/484 |
| 2003/0000014 | A1 | * | 1/2003 | Sopher et al. | 5/496 |
| 2003/0070232 | A1 | * | 4/2003 | Diak Ghanem | 5/496 |

FOREIGN PATENT DOCUMENTS

| | | | | | |
|---|---|---|---|---|---|
| GB | 2235132 | A | * | 2/1991 | 5/484 |

* cited by examiner

*Primary Examiner*—Robert G. Santos
(74) *Attorney, Agent, or Firm*—Robert M. Downey P.A.

(57) ABSTRACT

A bed sheet set for increasing comfort and protection of bedding has air permeable upper and lower panels. The lower panel encompasses a mattress and has a fastener for releasably securing the superposed upper panel. The upper panel has another fastener that releasably secures a minor liquid proof panel. The minor portion can be secured in place during sleep periods or periods of inactivity and selectively removed to increase air flow and comfort. When soiled, only the minor portion need be removed to extend the time between changing and laundering the entire bed sheet set.

7 Claims, 2 Drawing Sheets

QUICK CHANGE BEDSHEET SET

FIELD OF THE INVENTION

The invention relates to a set of bed sheets that are constructed to be used in combination with each other to facilitate ease of applying the sheets to bedding.

BACKGROUND OF THE INVENTION

There are numerous combinations of bed sheets designed to provide a quick and easy way to change bed linen. Also, numerous bed sheet designs result in a tight, neat, and wrinkle free fitting of the bed sheets about the mattress of the bed.

With the aging of the population, there is an increasing number of people, both in institutions and at home, who spend much of their time bedridden. The beds are used for night-time sleeping and for normal activities while the person is awake. Certain requirements of the bed linen necessary during sleeping periods may be uncomfortable for longer periods of normal activity. For example, it may be necessary to provide sheets with water proof properties during the night. However, these water proof sheets do not provide good air flow through the fabric and become hot and uncomfortable should the individual be confined to the bed during the day.

Current bed linens require the mattress to be removed or placed at such an angle so as to allow placement of linens around the mattress. These people and their care givers are not disposed, physically or financially, to completely change the bed linen to fit the changing activities during a day.

Alternatively the bed linens may include elastic material that allow for securement around the edges of the mattress. Elastic material can be troublesome to apply. If the elastic is too tight, the linens will be most difficult to secure. If the elastic material is too loose, the linens will become loose making the bedding area uneven and uncomfortable. Further, elastic will lose its resiliency after frequent washing resulting in premature replacement of the linen.

The problem is not limited to large mattress, even small mattresses such as those found in infant cribs are problematic. Infant mattresses found in a crib may have unique problems in that the mattresses is cornered in the four wall of the crib. Small children can also be difficult on a linens for they are very active in their sleep making the use of elastic for holding of the sheets, impractical.

DESCRIPTION OF THE PRIOR ART

U.S. Pat. No. 5,086,530 issued Feb. 11, 1992 to Blake teaches a set of bed linen having a top panel that is moisture proof and a bottom panel fitted about a mattress. The top and bottom panels have cooperating fasteners that allow the top panel to be removed and replaced from the mattress without disturbing the bottom panel.

U.S. Pat. No. 6,067,677 issued May 30, 2000 to Reen et al teaches a bed sheet in the form of a pouch with an open mouth. The pouch encloses a mattress. The sheet has a flap which is folded to close the open mouth. The sheet and the flap have cooperating fasteners to hold the flap in place.

U.S. Pat. No. 5,701,617 issued Dec. 30, 1997 to Colby teaches a bottom bed sheet folded about a mattress. The bed sheet has two end portions of water permeable textile attached on opposite sides of a moisture resistant center portion. The moisture resistant portion has a textile portion superposed and fastened to the water resistant portion. The fasteners are releasable.

U.S. Pat. No. 4,922,565 issued May 8, 1990 to Blake teaches a crib sheet combination having upper and lower panels. The lower panel is disposed upon the mattress with the edges folded about the mattress. The upper panel is moisture proof and is attached to the lower panel by releasable fasteners allowing the upper panel to be removed when soiled.

What is needed in the art is a bed sheet combination with a minor portion that can be easily and quickly configured for safety and sanitation during periods of sleep and maximum comfort during waking hours.

SUMMARY OF THE INVENTION

A bed sheet set for increasing comfort and protection of bedding having air permeable upper and lower panels. The lower panel encompasses the lower portion of a mattress and has a fastener for releasably securing the superposed upper panel. The upper panel has another fastener that releasably secures a minor liquid proof panel. The minor portion can be secured in place during sleep periods or periods of inactivity and selectively removed to increase air flow and comfort. When soiled, only the minor portion need be removed to extend the time between changing and laundering the entire bed sheet set.

Accordingly, it is an objective of the instant invention to teach the use of a set of bed sheets that provide discretionary protection from liquid discharge and reduce the number of bedding changes and laundry work load.

It is a further objective of the instant invention to teach the use of a set of bed sheets which may be used in a protective mode or a comfort mode.

It is yet another objective of the instant invention to teach the use of a set of bed sheets with a lower air permeable panel for securement to a mattress, an upper air permeable panel releasably fastened to the lower panel and a less air permeable smaller panel releasably attached to the upper panel so that the smaller panel, only, need be removed to increase air flow through the set and/or remove discharges.

It is a further objective of the invention to teach the use of a pillow-case lower panel with an elasticized edge and a Velcro fastener to secure the mattress inside the lower panel.

It is a still further objective of the invention to teach the discretionary removal of the smaller panel or the upper panel or both without removal of the lower panel.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Referring now to the figures, set forth is a conventional mattress 10 is shown with the sleeping surface and the vertical sides encompassed by lower panel 12. The extremities of the lower panel 12 may also be conventional and include seamed edges to facilitate a flat sleeping surface and a snug fit about the mattress. The lower panel may be made of woven or knitted cotton or other conventional yarns with a yarn count determining the air permeability of the panel.

Near the extremity of the lower panel 12 is a fastener 14 that extends around the perimeter of the lower panel. The location of the fastener is such that when the lower panel 12 is fitted onto the mattress, the fastener 14 is disposed about the periphery of the mattress. The fastener 14 may be a series of cooperating fasteners, such as button and button holes or male and female snaps or opposite sides of a zipper or Velcro or cohesive materials. The fasteners must be made of materials that will withstand numerous use and laundering cycles.

Figure 1:
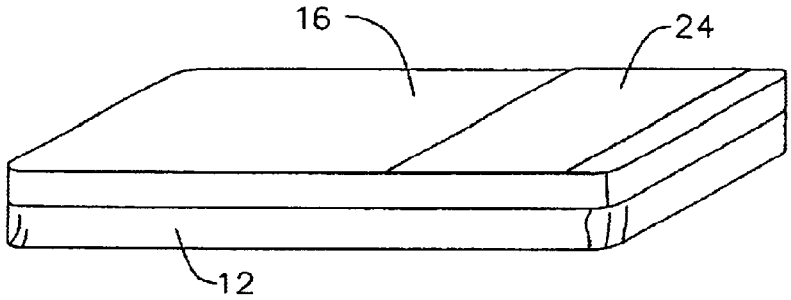
FIG. 1 illustrates a perspective view of the bed sheet of the instant invention placed over a mattress.
Figure 2:
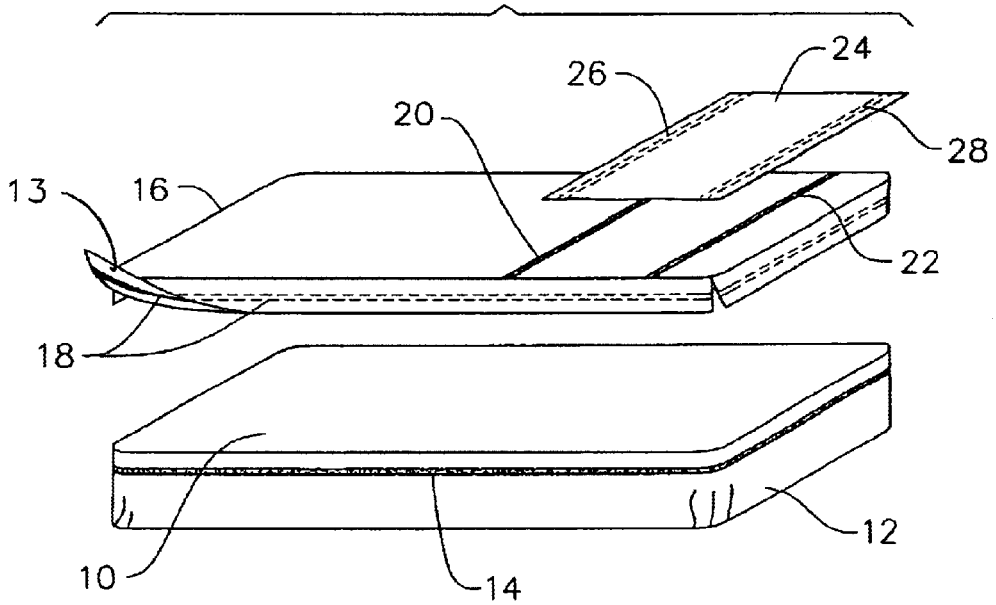
FIG. 2 illustrates an exploded perspective view of FIG. 1 of the bed sheet set of this invention.
Figure 3:
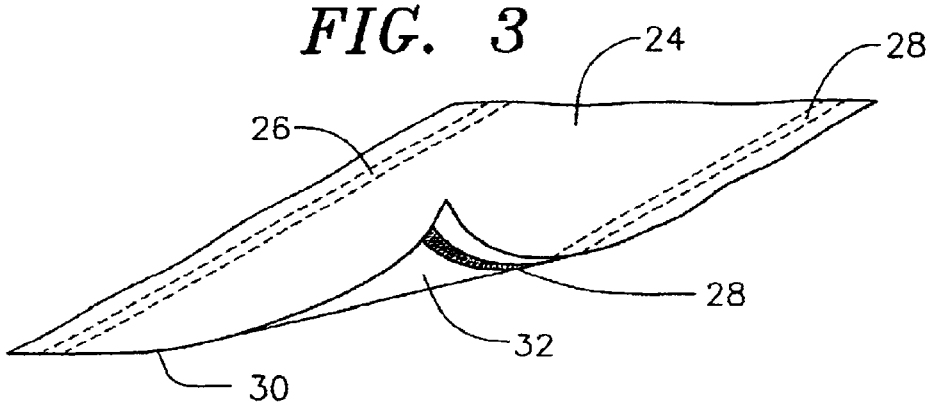
FIG. 3 illustrates an enlarged view of the minor panel.
Figure 4:
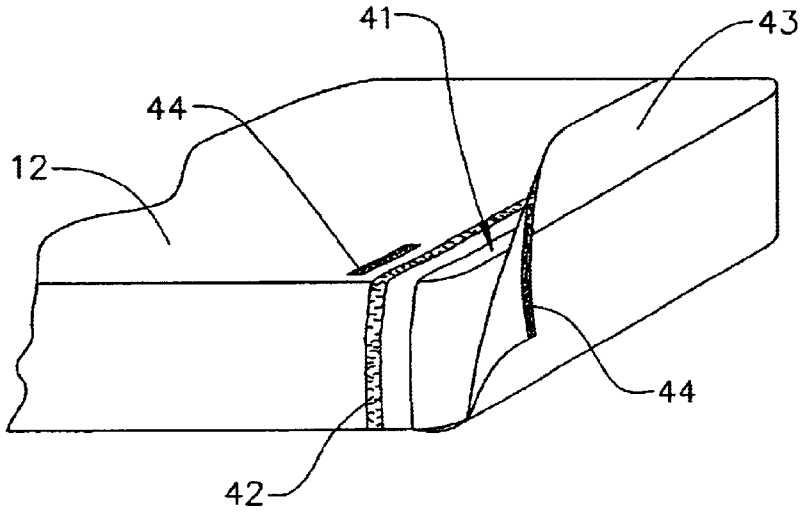
FIG. 4 illustrates the pillow-case lower panel of this invention.

In FIG. 4, the lower panel 12 is formed similarly to a pillow-case and encompasses the entire mattress. An opening 41 is made on one major surface for insertion of the mattress. This opening is preferably elasticized at 42. The end portion 43 is deployed to cover the end of the mattress. The elasticized edge and the free end of the end portion have cooperating elements of Velcro 44 for releasable closure of the pillow-case about the mattress.

An air permeable upper panel 16 is formed with a fly 13 to overlay the lower panel 12. There is a first fastener 18 attached to the periphery of the upper panel 16. This fastener is the cooperating opposite part of the fastener 14 described above. The upper panel 16 may be of the same or similar material as the lower panel 12 with similar yarn count and air permeability. The yarns may be natural or synthetic and, possibly, hydrophobic to increase the resistance of the panel to penetration of fluids.

The lower and upper panels may be deployed, alone, during waking hours, when a person using the bed may be capable of managing the bodily functions. During this period, the air permeability of the sheet set is normal without excessive heat build-up. The exposure of the upper panel 16 will dictate changing on a regular basis, for example every 3 days or a week. At such time, the fastener 18 will be unfastened and only the upper panel need be removed and changed.

The upper panel 16 has a second fastener made in accordance with the fastener 14, described above, attached to the panel. The second fastener has elements 20 and 22 which are shown as parallel to the short ends of the mattress. However, the fastener elements may be parallel to the long sides of the mattress or the elements may form a rectangle on the upper panel.

A minor panel 24 for covering part of the upper panel is shown with corresponding fastener elements 26 and 28 for releasably connecting to the fastener elements of the upper panel. The minor panel 24 is water or liquid proof with an absorbent layer 30 and another layer 32 which prevents the passage of liquids. The minor panel 24 may be made of tightly woven hydrophobic yarns, or a combination of layers of absorbent fabric and non-absorbent fabric, or a combination of an absorbent fabric with a impervious film backing. A minor portion of the other parts of the bed clothes and the mattress is protected from liquid discharges by the minor panel 24. The minor panels 24 may be made of different sizes to cover different portions of the upper panel.

Due to the minor panel 24 being water proof, the air permeability of the panel is restricted because of smaller interstice sizes in the layers or the use of a continuous film the minor panel. The lack of air permeability will normally contribute to a build up of temperature because body heat is not dissipated in the area of the minor panel.

At night, or during periods of lessened activity, the lack of air permeability is well tolerated. This is also the period in which most of the accidental discharges take place. However, during the day, or periods of more activity, the presence of the minor panel 24 may become uncomfortable to the bedridden user. By removing the minor panel, during the day, the air permeability is increased without significant disruption of the bedding.

Further, the use of the minor panel 24 will allow the care giver or the user to remove only the soiled minor portion of the bed sheet set and replace it with another minor panel quickly and easily. Also, the removal of only the minor panel reduces the laundry requirement for the user or care giver.

The instant invention provides a method of extending the period of time between changes of a set of bed sheets comprising the steps of a) providing said set with an absorbent porous lower panel having an attached continuous fastener, b) securing said lower panel about a mattress such that said fastener is disposed about the perimeter of said mattress, c) providing said set with an absorbent porous upper panel having a first attached continuous fastener and a second attached continuous fastener, d) releasably securing said fastener on said lower panel to said first fastener on said upper panel, e) providing said set with a plurality of minor panels having discrete edges and a fastener attached about said edges, said minor panels being absorbent and liquid proof, f) releasably securing said fastener of one of said plurality of minor panels to said second fastener of said upper panel, g) detaching said one of said plurality of minor panels from said upper panel while retaining said upper and lower panels on the mattress, and h) releasably securing said fastener of another of said plurality of minor panels to said second fastener of said upper panel thereby extending the time between changes of said set.

Further, the instant invention provides a method of changing the air permeability of a set of bed sheets during use comprising the steps of a) providing said set with an absorbent lower panel having an attached continuous fastener, said lower panel having a specific air permeability, b) securing said lower panel about a mattress such that said fastener is disposed about the perimeter of said mattress, c) providing said set with an absorbent upper panel having a first attached continuous fastener and a second attached continuous fastener, said upper panel having a specific air permeability similar to said lower panel, d) releasably securing said fastener on said lower panel to said first fastener on said upper panel resulting in a specific air permeability during use, e) providing said set with a minor panel having discrete edges and a fastener attached about said edges, said minor panel being absorbent and liquid proof, said minor panel having less air permeability than said lower and upper panels, f) releasably securing said fastener of said minor panel to said second fastener of said upper panel thereby reducing the air permeability of said set during use, and g) increasing air permeability during use by releasably detaching and removing said minor panel from said upper panel.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

What is claimed is:

1. A set of bed sheets for covering a mattress having a bottom surface, a top surface and an upstanding periphery, said set of bed sheets comprising:

a lower sheet of a size adapted to cover the bottom surface of the mattress and including a first continuous edge extending about a periphery thereof;

a first separable fastener disposed about said continuous edge of said lower sheet;

an upper sheet of a size adapted to cover the top surface of the mattress and including a second continuous edge extending about a periphery thereof;

a second separable fastener disposed about said second continuous edge of said upper sheet;

a fly extending from said second continuous edge of said upper sheet to overlay said second separable fastener of said upper sheet;

said first and second separable fasteners adapted to be temporarily connected to enclose the mattress whereby said upper sheet may be changed and said lower sheet may remain on the mattress for extended use;

a minor panel sized to overlay and cover at least a portion of said upper sheet, and said minor panel including a liquid-proof material;

a third separable fastener on said upper sheet;

a fourth separable fastener on said minor panel; and said third and fourth separable fasteners adapted to be temporarily attached to releasably secure said minor panel to said upper sheet, whereby said minor panel may be releasably removed without disturbing said upper and lower sheets.

2. The set of bed sheets as recited in claim 1 wherein said third and fourth separable fasteners are hook and loop type fasteners.

3. The set of bed sheets as recited in claim 1 wherein said third separable fastener on said upper sheet and said fourth separable fastener on said minor panel are selected from the group consisting of: zippers; buttons and buttonholes; male and female snaps; mutually cohesive materials; and hook and loop type fasteners.

4. The set of bed sheets as recited in claim 1 wherein said liquid-proof material of said minor panel is structured and disposed to prevent penetration of liquid through said minor panel, whereby an area of said upper sheet covered by said minor panel is shielded from exposure and contact with liquids.

5. The set of bed sheets as recited in claim 1 wherein said first separable fastener on said lower sheet and said second separable fastener on said upper sheet are selected from the group consisting of: zippers; buttons and buttonholes; male and female snaps; mutually cohesive materials; and hook and loop type fasteners.

6. The set of bed sheets as recited in claim 1 wherein said upper sheet and said lower sheet are formed as a one-piece case to encompass said mattress, said case having an end opening for inserting said mattress.

7. The set of bed sheets as recited in claim 1 wherein at least one of said upper sheet and said lower sheet includes a moisture resistant panel.

* * * * *